US008790552B2

(12) United States Patent
Park et al.

(10) Patent No.: US 8,790,552 B2
(45) Date of Patent: Jul. 29, 2014

(54) CONDUCTIVE WET COATING COMPOSITION AND THIN-FILM PREPARED THEREFROM

(75) Inventors: Jong-Jin Park, Yongin-si (KR); Jae-Hwan Kim, Seoul (KR)

(73) Assignee: Samsung Display Co., Ltd., Giheung-Gu, Yongin, Geyonggi-Do (KR)

( * ) Notice: Subject to any disclaimer, the term of this patent is extended or adjusted under 35 U.S.C. 154(b) by 1214 days.

(21) Appl. No.: 11/593,498

(22) Filed: Nov. 7, 2006

(65) Prior Publication Data

US 2007/0181856 A1 Aug. 9, 2007

(30) Foreign Application Priority Data

Feb. 6, 2006 (KR) ..... 10-2006-0011202

(51) Int. Cl.
*H01B 1/02* (2006.01)
*H01B 1/22* (2006.01)

(52) U.S. Cl.
USPC ..... 252/519.33; 252/512; 252/518.1; 427/123; 427/126.1; 428/323

(58) Field of Classification Search
USPC ..... 252/500, 512, 518.1, 519.33; 427/255.19, 255.25, 123, 126.1; 428/1.1, 323
See application file for complete search history.

(56) References Cited

U.S. PATENT DOCUMENTS

| | | | | |
|---|---|---|---|---|
| 6,153,127 | A * | 11/2000 | Nakamura et al. | 252/588 |
| 7,189,453 | B2 | 3/2007 | Kawamura et al. | |
| 7,438,832 | B2 * | 10/2008 | Majumdar et al. | 252/500 |
| 2001/0008207 | A1 * | 7/2001 | Ando et al. | 204/192.28 |
| 2003/0027000 | A1 * | 2/2003 | Greenberg et al. | 428/432 |
| 2005/0081370 | A1 | 4/2005 | Kurihara et al. | |
| 2006/0174932 | A1 | 8/2006 | Usui et al. | |
| 2006/0269695 | A1 * | 11/2006 | Daly et al. | 427/598 |
| 2007/0008439 | A1 | 1/2007 | Nakayama et al. | |
| 2007/0121193 | A1 * | 5/2007 | Akashi et al. | 359/296 |
| 2008/0258605 | A1 * | 10/2008 | Yukinobu | 313/504 |
| 2009/0027611 | A1 * | 1/2009 | Hegmann et al. | 349/182 |

FOREIGN PATENT DOCUMENTS

| | | | |
|---|---|---|---|
| JP | 2005093824 | | 4/2005 |
| JP | 2006253025 | A * | 9/2006 |
| KR | 1020040106947 | | 12/2004 |
| WO | 2005006482 | | 1/2005 |
| WO | WO2005024853 | * | 3/2005 |

OTHER PUBLICATIONS

A universal method for the synthesis of metal and metal sulfide cluster embedded in polymer matrices, Yukinobu et al, Journal of Materials Chemistry, 2003, vol. 13, p. 2927-2930.*
Novel Polymer Electrolytes Prepared by Copolymerization of Ionic Liquid Monomers, Polymers for Advanced Technologies 13, Yoshizawa et al., 2002, 589-594.*
The machine translation of JP 2006-253025, 2013.*
Korean Notice of Allowance issued Oct. 16, 2012 in connection with Korean Patent Application Serial No. 10-2006-0011202 and Request for Entry of the Accompanying Office Action attached herewith.

* cited by examiner

*Primary Examiner* — Mark Kopec
*Assistant Examiner* — Haidung Nguyen
(74) *Attorney, Agent, or Firm* — Robert E. Bushnell, Esq.

(57) ABSTRACT

A highly conductive wet coating composition including a molten salt and a highly conductive thin film prepared therefrom is provided. The highly conductive wet coating composition can be coated at room temperature and the thin film prepared therefrom has a good thin film characteristic and high conductivity.

20 Claims, No Drawings

CONDUCTIVE WET COATING COMPOSITION AND THIN-FILM PREPARED THEREFROM

CROSS-REFERENCE TO RELATED PATENT APPLICATION AND CLAIM OF PRIORITY

This application claims the benefit of Korean Patent Application No. 10-2006-0011202, filed on Feb. 6, 2006, in the Korean Intellectual Property Office, the disclosure of which is incorporated herein in its entirety by reference.

BACKGROUND OF THE INVENTION

1. Field of the Invention

The present invention relates to a conductive wet coating composition, and more particularly, to a conductive wet coating composition that can be coated at room temperature, and a conductive thin film having good thin film characteristics prepared therefrom.

2. Description of the Related Art

Conductive coating compositions are used in conductive paste of remote control switching, anti-static coating for CRTs to minimize accumulation of dust on the CRTs, electrode printing of organic electroluminescent devices, etc., in order to form a conductive thin film having a certain level of surface hardness.

These coating compositions can include polymer-type coating compositions and high-temperature sintered-type coating compositions, all of which are cured at a high temperature, which is uneconomical and inefficient.

On the other hand, methods of coating highly conductive materials cured at a low temperature using a filler fusion technique at a low temperature include reduction of silver oxide, thermal decomposition of an organic metal compound, surface activation by reducing a melting point of metal nanoparticles and a method of filler fusion by heating above the melting point of metals having a low melting point. However, if filler used is not uniformly dispersed, it is also difficult to obtain a good quality conductive film.

Examples of conductive polymers include polyethylenedioxythiophene (PEDOT), polyaniline, polypyrrole, polyacetylene, polyphenylene, polyphenylenevinylene, polythiophene, or copolymers or blends formed from two or more compounds selected from these compounds. High conductivity can be obtained by doping these compounds, but a change in conductivity according to a change in time is so big that it is difficult to obtain a stable film. Nanoceramics enhanced by ropes of single wall carbon nanotubes are known, but they have to be processed at a high temperature using a method such as spark plasma sintering or hot pressing.

SUMMARY OF THE INVENTION

The present invention provides a conductive wet coating composition that can be coated at room temperature and that has good thin film characteristics.

The present invention also provides a highly conductive thin film formed from the conductive wet coating composition.

According to an aspect of the present invention, there is provided a conductive wet coating composition comprising a conductive nanoparticle, a molten salt and a polymer binder.

The conductive nanoparticles can be at least one selected from the group consisting of metal oxide nanoparticles, metal nanoparticles, surface-substituted metal nanoparticles and semiconductor nanoparticles.

The molten salt can comprise an organic cation; and an organic or inorganic anion.

The polymer binder can be thermoplastic resin such as polyvinylbutyral, epoxy resin or thermosetting resin, or a conductive polymer.

According to an aspect of the present invention, there is provided a conductive wet coating composition, comprising: a conductive nanoparticle selected from the group consisting of a metal oxide nanoparticle, a metal nanoparticle, a surface-substituted metal nanoparticle and a semiconductor nanoparticle; a polymer binder comprising conductive resin and non-conductive resin; and a molten salt represented by one of Formula 1 and Formula 2:

(1)

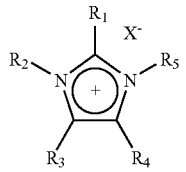

where each of $R_1$, $R_2$, $R_3$, $R_4$, and $R_5$ is independently a hydrogen atom, a halogen atom, a carboxyl group, an amino group, a nitro group, a cyano group, a hydroxyl group, a substituted or unsubstituted $C_1$-$C_{20}$ alkyl group, a substituted or unsubstituted $C_1$-$C_{20}$ alkoxy group, a substituted or unsubstituted $C_1$-$C_{20}$ silicon-containing group, a substituted or unsubstituted $C_1$-$C_{20}$ fluorine-containing group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group; and $X^-$ is halide, a borate-based anion, a phosphate-based anion, a phosphinate-based anion, an imide-based anion, a sulfonate-based anion, an acetate-based anion, a sulfate-based anion, a cyanate-based anion, a thiocyanate-based anion, a carbon-based anion, a complex-based anion, or $ClO_4^-$; and (2)

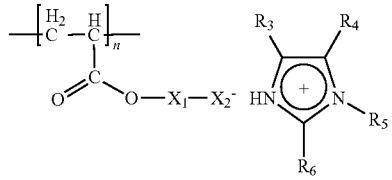

where $X_1$ is a substituted or unsubstituted $C_1$-$C_{10}$ alkylene group, a substituted or unsubstituted $C_6$-$C_{30}$ arylene group, a substituted or unsubstituted $C_1$-$C_{20}$ heteroalkylene group, or a substituted or unsubstituted $C_4$-$C_{30}$ heteroarylene group;

$X_2$ is a sulfonate-based anion, a cyanate-based anion, a thiocyanate-based anion, or a carboxylate-based anion;

each of $R_3$, $R_4$, $R_5$ and $R_6$ is independently a hydrogen atom, a halogen atom, a carboxyl group, an amino group, a nitro group, a cyano group, a hydroxyl group, a substituted or unsubstituted $C_1$-$C_{20}$ alkyl group, a substituted or unsubstituted $C_1$-$C_{20}$ alkoxy group, a substituted or unsubstituted $C_1$-$C_{20}$ silicon-containing group, a substituted or unsubstituted $C_1$-$C_{20}$ fluorine-containing group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group; and n is an integer in the range of 50 to 500.

The composition according to an embodiment of the present invention can further include a mixture of a soluble titanium precursor and $Al_2O_3$.

DETAILED DESCRIPTION OF THE INVENTION

Hereinafter, the present invention will be described in more detail by explaining embodiments of the invention.

A highly conductive wet coating composition according to an embodiment of the present invention includes conductive nanoparticles, a molten salt and a polymer binder.

The conductive nanoparticles can provide a wet coating composition having a low melting point and high conductivity, and can be any one selected from the group consisting of metal oxide nanoparticles, metal nanoparticles, surface-substituted metal nanoparticles, and semiconductor nanoparticles.

Metal oxide nanoparticles can be nano powders such as indium-tin oxide (ITO), antimony-tin oxide (ATO), etc., and may be Sn doped $In_2O_3$ in which the ratio of $In_2O_3$ to $SnO_2$ is 85:15-95:5. The metal oxide nanoparticles may have a surface resistance of 0.8 to $1\times10^4$ Ω/cm.

Examples of the metal nanoparticles include Au, Ag, Cu, Pd, Pt, Ag/Pd and Al nanoparticles. The silver/palladium (Ag/Pd) nanoparticles are used with a colloid solution having a particle size of 5 to 10 nm.

The surface-substituted metal nanoparticles can be metal nanoparticles represented by the following formula:

Formula (3)

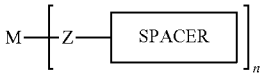

where M can be Au, Ag, Cu, Pd, Pt, Ag/Pd or Al; Z is S or CN; n is an integer in the range of 5 to 50; and SPACER is an alkyl group having 2-50 carbon atoms, benzene, diphenyl, or a hydrocarbon group having 2-50 carbon atoms including at least one group selected from the group consisting of —CONH—, —COO—, —Si—, bis-(porphyrin), —CO— and —OH.

Examples of surface-substituted nano particles represented by Formula 3 include 6-mercapto-1-hexanol and 1,3-benzenedithiol.

The semiconductor nanoparticles can be CdS, CdSe, CdTe, ZnS, ZnSe, ZnTe, HgS, HgSe, HgTe, GaN, GaP, GaAs, InP or InAs.

The amount of the conductive nanoparticles may be 20 to 200 parts by weight, and preferably 30 to 60 parts by weight, based on 100 parts by weight of a polymer binder. When the amount of the conductive nanoparticles is less than 20 parts by weight, conductivity is reduced. When the amount of the conductive nanoparticles is greater than 200 parts by weight, a uniform dispersed film can not be obtained.

The molten salt, which is used in the highly conductive wet coating composition according to the current embodiment of the present invention, is called ionic liquid (IL), and refers to a salt representing a liquid characteristic at room temperature. The molten salt comprises an organic cation and an inorganic or organic anion, and has a high evaporation temperature, high ionic conductivity, a heat-resisting property and an inflammable property.

By using this molten salt in the embodiment of the present invention, coating a solution is possible at a low temperature and a highly conductive thin film can be obtained.

The molten salt can be any salt that remains in a liquid state at room temperature, for example, a salt in which an inorganic anion is bound to an organic cation, or a salt in which an organic anion is bound to an organic cation.

The cation of the molten salt according to an embodiment of the present invention may be preferably at least one selected from the group consisting of a substituted or unsubstituted imidazolium, a substituted or unsubstituted pyrazolium, a substituted or unsubstituted triazolium, a substituted or unsubstituted thiazolium, a substituted or unsubstituted oxazolium, a substituted or unsubstituted pyridazinium, a substituted or unsubstituted pyrimidinium, a substituted or unsubstituted pyrazinium, a substituted or unsubstituted ammonium, a substituted or unsubstituted phosphonium, a substituted or unsubstituted guanidinium, a substituted or unsubstituted uronium, a substituted or unsubstituted thiouronium, a substituted or unsubstituted pyridinium, and a substituted or unsubstituted pyrrolidinium, and more preferably a substituted or unsubstituted imidazolium or a substituted or unsubstituted pyridinium.

More specific examples of cations of the molten salt include, but are not limited to, at least one selected from the group consisting of 1,3-dimethylimidazolium, 1-butyl-3-methylimidazolium, 1-ethyl-3-methylimidazolium, 1-hexadecyl-3-methylimidazolium, 1-hexyl-3-methylimidazolium, 3-methyl-1-octadecylimidazolium, 3-methyl-1-octylimidazolium, 3-methyl-teterdecylimidazolium, 1-butyl-2,3-dimethylimidazolium, 1-ethyl-2,3-dimethylimidazolium, 1-hexadecyl-2,3-dimethylimidazolium, 1-hexyl-2,3-dimethylimidazolium, 1,2,3-trimethylimidazolium; N-hexylpyridinium, N-butyl-3,4-dimethylpyridinium, N-butyl-3,5-dimethylpyridinium, N-butyl-3-methylpyridinium, N-butyl-4-methylpyridinium, N-butylpyridinium, N-ethylpyridinium, N-hexylpyridinium, N-octylpyridinium; 1,1-dimethylpyrolidinium, 1-butyl-1-methylpyrolidinium, 1-hexyl-1-methylpyrolidinium, 1-methyl-1-octylpyrolidinium; trihexyl(tetradecyl)phosphonium; methyltrioctylammonium, ethyl-dimethyl-propylammonium; guanidinium, N''-ethyl-N,N,N',N'-tetramethylguanidinium; O-ethyl-N,N,N',N'-tetramethylisouronium, and S-ethyl-N,N,N',N'-tetramethylisothiouronium.

The anion that binds with the above cation to form the molten salt can be an organic or inorganic anion. Examples of the anion include at least one selected from the group consisting of halide, a borate-based anion, a phosphate-based anion, a phosphinate-based anion, an imide-based anion, a sulfonate-based anion, an acetate-based anion, a sulfate-based anion, a cyanate-based anion, a thiocyanate-based anion, a carbon-based anion, a complex-based anion and $ClO_4^-$.

More specific examples of the anion may include at least one selected from the group consisting of $PF_6^-$, $BF_4^-$, $B(C_2O_4)^-$, $CH_3(C_6H_5)SO_3^-$, $(CF_3CF_2)_2PO_2^-$, $CF_3SO_3^-$, $CH_3SO_4^-$, $CH_3(CH_2)_7SO_4^-$, $N(CF_3SO_2)_2^-$, $N(C_2F_5SO_2)_2^-$, $C(CF_2SO_2)_3^-$, $AsF_6^-$, $SbF_6^-$, $AlCl_4^-$, $NbF_6^-$, $HSO_4^-$, $ClO_4^-$, $CH_3SO_3^{31}$ and $CF_3CO_2^-$.

Such cations and anions combine with each other to form a molten salt represented by Formula 1 below:

Formula (1)

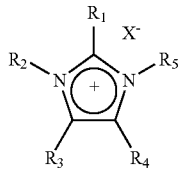

where each of $R_1$, $R_2$, $R_3$, $R_4$, and $R_5$ is independently a hydrogen atom, a halogen atom, a carboxyl group, an amino group, a nitro group, a cyano group, a hydroxyl group, a substituted or unsubstituted $C_1$-$C_{20}$ alkyl group, a substituted or unsubstituted $C_1$-$C_{20}$ alkoxy group, a substituted or unsubstituted $C_1$-$C_{20}$ silicon-containing group, a substituted or unsubstituted $C_1$-$C_{20}$ fluorine-containing group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroaryl alkyl group; and $X^-$ can be halide, a borate-based anion, a phosphate-based anion, a phosphinate-based anion, an imide-based anion, a sulfonate-based anion, an acetate-based anion, a sulfate-based anion, a cyanate-based anion, a thiocyanate-based anion, a carbon-based anion, a complex-based anion, or $ClO_4^-$.

The examples of the molten salt include 1,3-dimethylimidazolium trifluoromethanesulfonate, 1-butyl-3-methylimidazolium bromide, 1-butyl-3-methylimidazolium chloride, 1-butyl-3-methylimidazolium hexafluorophosphate, 1-butyl-3-methylimidazolium hexafluorophosphate, 1-butyl-3-methylimidazolium iodide, 1-butyl-3-methylimidazolium methylsulfate, 1-butyl-3-methylimidazolium octylsulfate, 1-butyl-3-methylimidazolium tetrafluoroborate, 1-butyl-3-methylimidazolium trifluoromethylsulfonate, 1-butyl-3-methylimidazolium trifluoroacetate, 1-ethyl-3-methylimidazolium bis[oxalato]borate, 1-ethyl-3-methylimidazolium bromide, 1-ethyl-3-methylimidazolium chloride, 1-ethyl-3-methylimidazolium hexafluorophosphate, 1-ethyl-3-methylimidazolium methylsulfate, 1-ethyl-3-methylimidazolium p-toluenesulfonate, 1-ethyl-3-methylimidazolium tetrafluoroborate, 1-ethyl-3-methylimidazolium thiocyanate, 1-ethyl-3-methylimidazolium trifluoromethanesulfonate, 1-ethyl-3-methylimidazolium trifluoroacetate, 1-ethyl-3-methylimidazolium bis(pentafluoroethyl)phosphinate, 1-hexadecyl-3-methylimidazolium chloride, 1-hexyl-3-methylimidazolium bis(trifluoromethylsulfonyl)imide, 1-hexyl-3-methylimidazolium chloride, 1-hexyl-3-methylimidazolium hexafluorophosphate, 1-hexyl-3-methylimidazolium tetrafluoroborate, 1-hexyl-3-methylimidazolium tri(pentafluoroethyl)trifluorophosphate, 3-methyl-1-octadecylimidazolium bis(trifluorosulfonyl)imide, 3-methyl-1-octadecylimidazolium hexafluorophosphate, 3-methyl-1-octadecylimidazolium tri(pentafluoroethyl) trifluorophosphate, 3-methyl-1-octylimidazolium bis (trifluoromethylsulfonyl)imide, 3-methyl-1-octylimidazolium chloride, 3-methyl-1-octylimidazolium hexafluorophosphate, 3-methyl-1-octylimidazolium octylsulfate, 3-methyl-1-octylimidazolium tetrafluoroborate, 3-methyl-1-tetradecylimidazolium tetrafluoroborate, 1-propyl-3-methylimidazolium iodide; 1-butyl-2,3-dimethylimidazolium chloride, 1-butyl-2,3-dimethylimidazolium hexafluorophosphate, 1-butyl-2,3-dimethylimidazolium iodide, 1-butyl-2,3-dimethylimidazolium octylsulfate, 1-butyl-2,3-dimethylimidazolium tetrafluoroborate, 1-ethyl-2,3-dimethylimidazolium bromide, 1-ethyl-2,3-dimethylimidazolium chloride, 1-ethyl-2,3-dimethylimidazolium hexafluorophosphate, 1-ethyl-2,3-dimethylimidazolium p-toluenesulfonate, 1-ethyl-2,3-dimethylimidazolium tetrafluoroborate, 1-hexadecyl-2,3-dimethylimidazolium chloride, 1-hexyl-2,3-dimethylimidazolium chloride, 1,2,3-trimethylimidazolium iodide; N-hexylpyridinium bis (trifluoromethylsulfonyl)imide, N-butyl-3,4-dimethylpyridinium chloride, N-butyl-3,5-dimethylpyridinium chloride, N-butyl-3-methylpyridinium chloride, N-butyl-4-methylpyridinium bromide, N-butyl-4-methylpyridinium chloride, N-butyl-4-methylpyridinium hexafluorophosphate, N-butyl-4-methylpyridinium tetrafluoroborate, N-butylpyridinium chloride, N-butylpyridinium hexafluorophosphate, N-butylpyridinium trifluoromethanesulfonate, N-ethylpyridinium bromide, N-ethylpyridinium chloride, N-hexylpyridinium hexafluorophosphate, N-hexylpyridinium tetrafluoroborate, N-hexylpyridinium trifluoromethylsulfonate, N-octylpyridinium chloride; 1,1-dimethylpyrolidinium iodide, 1-butyl-1-methylpyrolidinium bis(trifluoromethylsulfonyl)imide, 1-butyl-1-methylpyrolidinium chloride, 1-butyl-1-methylpyrolidinium hexafluorophosphate, 1-butyl-1-methylpyrolidinium tetrafluoroborate, 1-butyl-1-methylpyrolidinium trifluoroacetate, 1-butyl-1-methylpyrolidinium trifluoromethylsulfonate, 1-butyl-1-methylpyrolidinium tri (pentafluoroethyl)trifluorophosphate, 1-butyl-1-methylpyrolidinium bis[oxalato(2-)]borate, 1-hexyl-1-methylpyrolidinium chloride, 1-methyl-1-octylpyrolidinium chloride; trihexyl(tetradecyl)phosphonium bis(trifluoromethylsulfonyl)imide, trihexyl(tetradecyl)phosphonium bis[oxalato(2-)] borate, trihexyl(tetradecyl)phosphonium chloride, trihexyl (tetradecyl)phosphonium hexafluorophosphate, trihexyl (tetradecyl)phosphonium tetrafluoroborate, trihexyl (tetradecyl)phosphonium tri(pentafluoroethyl) trifluorophosphate; 1-hexyl-3-methylimidazoliumtris (pentafluoroethyl)trifluorophosphate, 1-butyl-3-methylimidazoliumtris(pentafluoroethyl)trifluorophosphate, 1-butyl-3-methylimidazoliumhexafluorophosphate; methyltrioctylammonium bis(trifluoromethylsulfonyl)imide, methyltrioctylammonium trifluoroacetate, methyltrioctylammonium trifluoromethylsulfonate, ethyl-dimethylpropylammonium bis(trifluoromethylsulfonyl)imide; guanidinium trifluoromethylsulfonate, guanidinium tri(pentafluoroethyl)trifluorophosphate, N"-ethyl-N,N,N',N'-tetramethylguanidinium trifluoromethylsulfonate, N"-ethyl-N,N,N',N'-tetramethylguanidinium tri(pentafluoroethyl) trifluorophosphate; O-ethyl-N,N,N',N'-tetramethylisouronium trifluoromethylsulfonate, O-ethyl-N,N,N',N'-tetramethylisouronium tri(pentafluoroethyl) trifluorophosphate, S-ethyl-N,N,N',N'-tetramethylisothiouronium trifluoromethylsulfonate, and S-ethyl-N,N,N',N'-tetramethylisouronium tri(pentafluoroethyl)trifluorophosphate.

Also, the molten salt according to an embodiment of the present invention can be a polymer molten salt represented by Formula 2:

Formula (2)

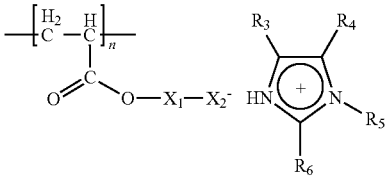

where $X_1$ is a substituted or unsubstituted $C_1$-$C_{10}$ alkylene group, a substituted or unsubstituted C6-C30 arylene group, a substituted or unsubstituted $C_1$-$C_{20}$ heteroalkylene group, or a substituted or unsubstituted $C_4$-$C_{30}$ heteroarylene group; $X_2$ is a sulfonate-based anion, a cyanate-based anion, a thiocyanate-based anion, or a carboxylate-based anion; each of $R_3$, $R_4$, $R_5$ and $R_6$ is independently a hydrogen atom, a halogen atom, a carboxyl group, an amino group, a nitro group, a cyano group, a hydroxyl group, a substituted or unsubstituted $C_1$-$C_{20}$ alkyl group, a substituted or unsubstituted $C_1$-$C_{20}$ alkoxy group, a substituted or unsubstituted $C_1$-$C_{20}$ silicon-containing group, a substituted or unsubstituted $C_1$-$C_{20}$ fluorine-containing group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroaryl alkyl group; and n is an integer in the range of 50 to 500.

The compound of Formula 2 is a polymer molten salt and preferably has a number average molecule weight of 1,000 to 30,000. The compound of Formula 2 can be co-polymerized with other polymers, thereby forming a bipolymer or a terpolymer.

The term "substituted" used in a definition of the above compound of Formulas 1 and 2 refers to a state in which at least one hydrogen atom existing in the above substituents is each independently substituted with appropriate substituents. Examples of these substituents include a halogen atom, a carboxyl group, an amino group, a nitro group, a cyano group, a substituted or unsubstituted $C_1$-$C_{20}$ alkyl group, a substituted or unsubstituted $C_1$-$C_{20}$ alkoxy group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, and a substituted or unsubstituted $C_3$-$C_{30}$ heteroarylalkyl group.

Of the substituents used herein, the alkyl group may be a straight or branched alkyl group having 1-20 carbon atoms, preferably a straight or branched alkyl group having 1-12 carbon atoms, and more preferably a straight or branched alkyl group having 1-6 carbon atoms. Examples of the alkyl group include methyl, ethyl, n-propyl, isopropyl, n-butyl, isobutyl, sec-butyl, t-butyl, pentyl, isoamyl, hexyl, etc. At least one hydrogen atom included in the alkyl group can be further substituted with a halogen atom so that the alkyl group can be a haloalkyl group.

Of the substituents used herein, the alkoxy group may be a C1-C20 straight or branched alkoxy group, preferably an alkoxy group having 1-6 carbon atoms, and more preferably an alkoxy group having 1-3 carbon atoms. Examples of the haloalkoxy group include methoxy, ethoxy, propoxy, buthoxy, and t-buthoxy. The alkoxy group described above can be further substituted with at least one halo atom such as fluoro, chloro or bromo so that the alkoxy group can be a haloalkoxy group. Examples of the alkoxy group include fluoromethoxy, chloromethoxy, trifluoromethoxy, trifluoroethoxy, fluoroethoxy and fluoropropoxy.

Of the substituents used herein, the alkenyl group refers to a $C_2$-$C_{20}$ straight or branched aliphatic hydrocarbon group that has a carbon-carbon double bond, preferably having 2-12 carbon atoms, and more preferably having 2-6 carbon atoms. The branched alkenyl group refers to an alkenyl group in which at least one lower alkyl or lower alkenyl group is attached to a straight chain thereof. Such an alkenyl group is not substituted, or can be independently substituted with at least one group including, but not being limited to, halo, carboxy, hydroxy, formyl, sulfo, sulfino, cabamoyl, amino and imino. Examples of the alkenyl group include ethenyl, prophenyl, carboxyethenyl, carboxyprophenyl, sulfinoethenyl and sulfonoethenyl.

Of the substituents used herein, the alkynyl group refers to a $C_2$-$C_{20}$ straight or branched aliphatic hydrocarbon that has a carbon-carbon triple bond. Preferably, the alkynyl group has 2-12 carbon atoms, and more preferably the alkynyl group has 2-6 carbon atoms. The branched alkynyl group refers to an alkynyl group in which at least one lower alkyl group and lower alkynyl group are attached to an alkynyl straight chain. Such an alkynyl group is not substituted, or can be independently substituted with at least one group including, but not being limited to, halo, carboxy, hydroxy, formyl, sulfo, sulfino, cabamoyl, amino and imino.

Of the substituents used herein, the heteroalkyl group includes a hetero atom, for example, N, O, P, S, etc., within a main chain of $C_1$-$C_{20}$, preferably $C_1$-$C_{12}$, and more preferably $C_1$-$C_6$ in the alkyl group described above.

Of the substituents used herein, the aryl group is used alone or in combination. The aryl group refers to a $C_6$-$C_{30}$ carbocycle aromatic system having at least one ring and the rings can be attached or fused together using a pendant method. The term "aryl" includes an aromatic radical such as phenyl, naphtyl, tetrahydronaphtyl, indane and biphenyl, and preferably phenyl. The aryl group can have 1-3 substituents such as hydroxyl, halo, haloalkyl, nitro, cyano, alkoxy and lower alkylamino.

Of the substituents used herein, the arylalkyl group refers to a group in which at least one hydrogen atom of the alkyl group is substituted with the aryl group described above.

Of the substituents used herein, the heteroarylalkyl group refers to a group in which at least one hydrogen atom of the alkyl group defined above is substituted with the heteroaryl group described above, and a $C_3$-$C_{30}$ carbocycle aromatic system.

The heteroaryl group in the compound of Formulas 1 and 2 refers to a monovalent monocyclic or bicyclic aromatic radical having 5-30 ring atoms in which 1, 2 or 3 hetero atoms selected from N, O, or S are included and the rest ring atom is C. Also, the term "heteroaryl" refers to a monovalent monocyclic or bicyclic aromatic radical in which a hetero atom in a ring is oxydized or four-elemented, resulting in, for example, N-oxide or quaternary salts. Examples of the heteroaryl group include thienyl, benzothienyl, pyridil, pyrazinyl, pyrimidinyl, pyridazinyl, quinolinyl, quinoxalinyl, imidazolyl, furanyl, benzofuranyl, thiazolyl, isoxazoline, benzisoxazoline, benzimidazolyl, triazolyl, pyrazolyl, pyrrolyl, indolyl, 2-pyridonyl, N-alkyl-2-pyridonyl, pyrazinonyl, pyridazinonyl, pyrimidinonyl, oxazolonyl and corresponding N-oxides (for example, pyridyl N-oxide and quinolinyl N-oxide), and quaternary salts thereof, but are not limited thereto.

The amount of the molten salt described above may be 10 to 100 parts by weight, and preferably 20 to 60 parts by weight, based on 100 parts by weight of the polymer binder.

The polymer binder according to an embodiment of the present invention increases viscosity of the conductive wet coating composition, thereby providing a thin film with good stability, good adhesiveness and coating uniformity.

Examples of the polymer binder include a conductive resin such as polyacetylene (PA), polythiophene (PT), poly(3-alkyl)thiophene (P3AT), polypyrrole (PPY), polyisothianapthelene (PITN), polyethylene dioxythiophene (PEDOT), polyparaphenylene vinylene (PPV), poly(2,5-dialkoxy)paraphenylene vinylene, polyparaphenylene (PPP), polyparaphenylene sulfide (PPS), polyheptadiene (PHT), or poly(3-hexyl)thiophene[P3HT], polyaniline (PANI) and mixture thereof, and a nonconductive resin such as polyester, polycarbonate, polyvinylalcohol, polyvinylbutyral, polyacetal, polyarylate, polyamide, polyamideimide, polyetherimide, polyphenyleneether, polyphenylenesulfide, polyethersulfon, polyetherketone, polyphthalamide, polyethernitrile, polyethersulfon, polybenzimidazole, polycarbodiimide, polysiloxane, polymethylmethacrylate, polymethacrylamide, nitrile rubber, acryl rubber, polyethylenetetrafluoride, epoxy resin, phenol resin, melamine resin, urea resin, polybutene, polypentene, ethylene-prophylene copolymer, ethylene-butylene-diene copolymer, polybutadiene, polyisoprene, ethylene-propylene-diene copolymer, butyl rubber, polymethylpentene, polystyrene, styrene-butadiene copolymer, hydrogenated styrene-butadiene copolymer, hydrogenated polyisoprene, hydrogenated polybutadiene and a mixture thereof. The molecular weight of the nonconductive polymer may be 3,000 to 30,000, considering its solubility and coating property.

The highly conductive wet coating composition according to the current embodiment of the present invention can further include a mixture of $Al_2O_3$ and a soluble titanium precursor in addition to the elements described above. $Al_2O_3$ and a titanium precursor are materials having a high dielectric constant among insulating materials and electrons can move easily.

Preferably, $Al_2O_3$ used herein may have a specific surface area of 90 to 140 $m^2/g$ and a particle size of 20-150 nm. Examples of a commercialized $Al_2O_3$ include PURALOX/CATALOX SBa series, PURALOX/CATALOX SCFa series, PURALOX/CATALOX SCCa series, PURALOX NGa series, PURALOX TH100/150, CARALOX HTa HTFa 101, and PURALOX SCFa-140L3.

The soluble titanium precursor described above can be any one compound selected from the groups represented by Formulas 4 through 7:

$Ti(OR)_4$ Formula (4)

where R is each independently $CH_3CO—CH=CHCH_2—$, $C_2H_5OCO—CH=CHCH_2—$, $—CH_2CH_2—COO—NH_4^+$, —COR', —CO($C_6H_4$)COOR" or C1-C10 alkyl group wherein R' is a substituted or unsubstituted $C_1$-$C_{10}$ alkyl group; R" is a substituted or unsubstituted $C_1$-$C_{20}$ alkyl group;

Formula (5)

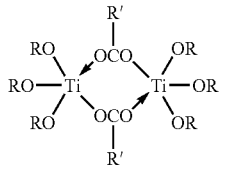

where R is a substituted or unsubstituted $C_1$-$C_{10}$ alkyl group, and R' is a substituted or unsubstituted $C_1$-$C_{10}$ alkyl group;

Formula (6)

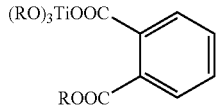

where R is a substituted or unsubstituted $C_1$-$C_{10}$ alkyl group; and

Formula (7)

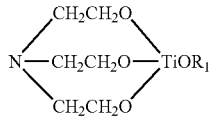

where $R_1$ is a substituted or unsubstituted $C_1$-$C_{10}$alkyl group.

The soluble titanium precursor described above can be tetraalkyltitanate or titanate chelate. The term "soluble property" refers to a property in which a material can be dissolved in an organic solvent, thereby remaining in a liquid state.

Examples of the above tetraalkyltitanate include tetraisopropyl titanate, tetra-n-buthyltitanate, tetrakis(2-ethylhexyl) titanate, titanium ethoxide or chlorotitanium triisopropoxide.

The titanate chelate described above can be any one selected from the group represented by the following formula:

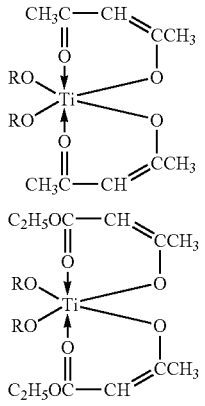

-continued

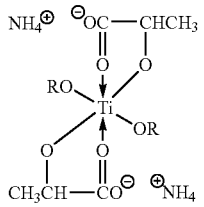

where R is a $C_1$-$C_{10}$ alkyl group.

The titanate chelate described above may be acetylacetonate titanate chelate, ethyl acetoacetate titanate chelate, triethanolamine titanate or an ammonium salt of lactic acid titanate chelate.

The weight ratio of the $Al_2O_3$ and the soluble titanium precursor can be 1:9 to 4:1. When the weight ratio is not within this range, efficiency is reduced due to a small amount of $Al_2O_3$.

The soluble $TiO_2$ precursor described above is converted into $TiO_2$ complex by heating it for more than 10 minutes at a temperature of 120 to 150° C. in a process of manufacturing a thin film.

The highly conductive wet coating composition according to the current embodiment of the present invention can further include a solvent and an additive in addition to the elements described above.

Examples of the solvent include isopropyl alcohol, buthanol, hexanol, toluene, chlorobezene, DMF, etc. The amount of the solvent may be 30-50 parts by weight based on 100 parts by weight of the polymer binder. When the amount of the solvent is less than 30 parts by weight, uniform coating property cannot be obtained due to high viscosity. When the amount of the solvent is greater than 50 parts by weight, uniform coating cannot be obtained due to low viscosity.

The additive can be an antifoaming agent, a leveling agent or a polishing agent.

The highly conductive wet coating composition according to the current embodiment of the present invention is coated and dried to obtain a highly conductive thin film.

A coating method can be, but is not particularly limited to, a spin coating method, an inkjet printing method, or a roll printing method.

The highly conductive thin film according to an embodiment of the present invention can be used in an electrode, a switching-contact device or an electron transport layer of an organic electroluminescent device.

Hereinafter, embodiments of the present invention will be described in further detail with reference to the following examples. These examples are for illustrative purposes only and are not intended to limit the scope of the present invention.

Characteristics of thin films prepared in the following embodiments and comparative embodiments were measured using the following methods:

Resistance

Resistance was measured by a 4-point probe measurement apparatus.

Adherence

A thin film was scratched to have a 10×10 cross stripe through a cross-cut test. Then, the degree to which the thin film was separated from a material using a tape was determined.

X: the thin film was separated by more than 50%

Δ: the thin film was separated by less than 30%

○: the thin film was separated by less than 10%

Coating Property

X: a coating film was not formed

Δ: a coating film was partially formed

○: a uniform coating film was formed

Hardness

Hardness was measured through a pencil hardness test, using an ASTM D3363 method.

X: the thin film was scratched with a 1H pencil

Δ: the thin film was scratched with a 2H pencil

○: the thin film was scratched with a 3H pencil

EXAMPLE 1

0.2 g of 1-ethyl-3-methylimidazolium chloride (Merck Corporation), 10 ml of isopropyl alcohol, 0.2 g of polyvinylbutyral (Butvar B-79) and 0.2 g of ITO nano powder (Particle Size 10-12 nm, manufacturer: Advanced Nano Products Co., Ltd., Korea) were mixed to obtain a wet coating composition according to an embodiment of the present invention. The wet coating composition was coated using a spin coating method and then dried at a temperature of 150° C. to form a 300 nm thin film. The tests described above were performed on the obtained thin film.

EXAMPLE 2

A thin film was prepared in the same manner as in Example 1, except that 0.2 g of $Al_2O_3$ and 0.2 g of tetraisoprophyl titanate as a soluble $TiO_2$ precursor were further added.

EXAMPLE 3

A thin film was prepared in the same manner as in Example 1, except that silver/palladium colloid solution (0.3 g based on silver/palladium nano particles; Particle Size 5 nm to 10 nm, manufacturer: Advanced Nano Products Co., Ltd., Korea) was used instead of ITO nano powder.

EXAMPLE 4

A thin film was prepared in the same manner as in Example 2, except that 0.3 g of a silver/palladium colloid solution (Particle Size 5 nm to 10 nm, manufacturer: Advanced Nano Products Co., Ltd., Korea) was used instead of ITO nano powder.

COMPARATIVE EXAMPLE 1

0.05 g of ITO nano powder was dispersed in 10 ml of isopropyl alcohol, and then the product was coated using a spin coating method and dried at a temperature of 150° C.

COMPARATIVE EXAMPLE 2

A thin film was prepared in the same manner as in Comparative Example 1, except that 0.2 g of polyvinyl butyral was further added.

COMPARATIVE EXAMPLE 3

0.3 g of silver/palladium colloid solution (Particle Size 5 nm to 10 nm, manufacturer: Advanced Nano Products Co., Ltd., Korea) was dispersed in 10 ml of isopropyl alcohol. Then, the product was coated using a spin coating method and dried at a temperature of 150° C.

COMPARATIVE EXAMPLE 4

A thin film was prepared in the same manner as in Comparative Example 3, except that 0.2 g of polyvinyl butyral was further added.

TABLE 1

| Class | Resistance | Adhesion | Coating Property | Hardness | Remark |
|---|---|---|---|---|---|
| Example 1 | $6.2 \times 10^{-3}$ to $8.2 \times 10^{-3}$ | Δ | ○ | Δ | A film was formed well |
| Example 2 | $7.2 \times 10^{-3}$ to $9.2 \times 10^{-3}$ | ○ | ○ | ○ | A film was formed well |
| Example 3 | $6.1 \times 10^{-4}$ to $8.5 \times 10^{-4}$ | Δ | ○ | Δ | A film was formed well |
| Example 4 | $6.2 \times 10^{-4}$ to $8.3 \times 10^{-4}$ | ○ | ○ | ○ | A film was formed well |
| Comparative Example 1 | could not be measured | X | X | X | A film was not formed |
| Comparative Example 2 | $2.1 \times 10^{-2}$ to $4.2 \times 10^{-2}$ | ○ | ○ | X | A film was formed well |
| Comparative Example 3 | could not be measured | X | X | X | A film was not formed |
| Comparative Example 4 | $4.7 \times 10^{-3}$ to $7.9 \times 10^{-3}$ | ○ | ○ | X | A film was formed well |

As can be seen from Table 1, the thin film prepared by wet-coating the composition according to the embodiments of the present invention has a good thin film characteristic and high conductivity, in addition to good hardness.

The highly conductive wet coating composition according to the embodiments of the present invention has a good thin film characteristic and can be wet coated at room temperature. The highly conductive thin film prepared therefrom can be used in an electrode, a switching contact device or an electron transport layer of an organic electroluminescent device.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A conductive wet coating composition, comprising:

a conductive nanoparticle;

a molten salt comprising a polymer compound represented by Formula 2;

(2)

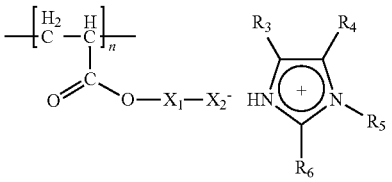

where $X_1$ is a substituted or unsubstituted $C_1$-$C_{10}$ alkylene group, a substituted or unsubstituted $C_6$-$C_{30}$ arylene group, a substituted or unsubstituted $C_1$-$C_{20}$ heteroalkylene group, or a substituted or unsubstituted $C_4$-$C_{30}$ heteroarylene group;

$X_2$ is a sulfonate-based anion, a cyanate-based anion, a thiocyanate-based anion, or a carboxylate-based anion;

each of $R_3$, $R_4$, $R_5$ and $R_6$ is independently a hydrogen atom, a halogen atom, a carboxyl group, an amino group, a nitro group, a cyano group, a hydroxyl group, a substituted or unsubstituted $C_1$-$C_{20}$ alkyl group, a substituted or unsubstituted $C_1$-$C_{20}$ alkoxy group, a substituted or unsubstituted $C_1$-$C_{20}$ silicon-containing group, a substituted or unsubstituted $C_1$-$C_{20}$ fluorine-containing group, a substituted or unsubstituted $C_2$-$C_{20}$ alkenyl group, a substituted or unsubstituted $C_2$-$C_{20}$ alkynyl group, a substituted or unsubstituted $C_1$-$C_{20}$ heteroalkyl group, a substituted or unsubstituted $C_6$-$C_{30}$ aryl group, a substituted or unsubstituted $C_7$-$C_{30}$ arylalkyl group, a substituted or unsubstituted $C_5$-$C_{30}$ heteroaryl group, or a substituted or unsubstituted $C_3$-$C_{30}$ heteroarylalkyl group; and n is an integer in the range of 50 to 500;

a polymer binder; wherein the conductive nanoparticle is at least one selected from the group consisting of a metal oxide nanoparticle, a metal nanoparticle, a surface-substituted metal nanoparticle and a semiconductor nanoparticle.

2. The conductive wet coating composition of claim 1, wherein the amount of the molten salt is 10 to 100 parts by weight based on 100 parts by weight of the polymer binder.

3. The conductive wet coating composition of claim 1, wherein the amount of the conductive nanoparticle is 20 to 70 parts by weight based on 100 parts by weight of the polymer binder.

4. The conductive wet coating composition of claim 1, wherein the metal oxide nanoparticle is indium-tin oxide (ITO) or antimony-tin oxide (ATO).

5. The conductive wet coating composition of claim 1, wherein the metal nanoparticle is Au, Ag, Cu, Pd, Pt, Ag/Pd or Al nanoparticle.

6. The conductive wet coating composition of claim 1, wherein the surface-substituted metal nanoparticle is a particle represented by Formula 3:

(3)

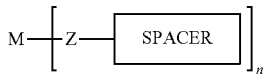

where M is a metal elected from the group consisting of Au, Ag, Cu, Pd, Pt, Ag/Pd and Al;

Z is S or CN;

n is an integer in the range of 5 to 50; and

SPACER is an alkyl group having 2-50 carbon atoms, benzene, diphenyl, or hydrocarbon having 2-50 carbon atoms having at least one group selected from the group consisting of —CONH—, —COO—, —Si—, bis-(porphyrin), —CO— and —OH.

7. The conductive wet coating composition of claim 1, wherein the semiconductor nanoparticle is CdS, CdSe, CdTe, ZnS, ZnSe, ZnTe, HgS, HgSe, HgTe, GaN, GaP, GaAs, InP or InAs.

8. The conductive wet coating composition of claim 1, wherein the polymer binder is a mixture of conductive resin and nonconductive resin.

9. The conductive wet coating composition of claim 1, further comprising a mixture of $Al_2O_3$ and a soluble titanium precursor.

10. The conductive wet coating composition of claim 9, wherein a weight ratio of the $Al_2O_3$ to the soluble titanium precursor is 1:9 to 4:1.

11. The conductive wet coating composition of claim 9, wherein the soluble titanium precursor is at least one selected from compounds represented by Formulas 4 through 7:

$$Ti(OR)_4 \quad (4)$$

where R is independently $CH_3CO—CH=CHCH_2—$, $C_2H_5OCO—CH=CHCH_2—$, $—CH_2CH_2—COO—NH_4^+$, —COR', —CO($C_6H_4$)COOR", or C1-C10 alkyl group, wherein R' is a substituted or unsubstituted C1-C10 alkyl group; R" is a substituted or unsubstituted C1-C10 alkyl group;

(5)

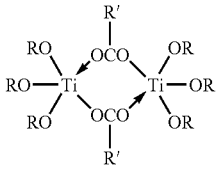

where R is a substituted or unsubstituted $C_1$-$C_{10}$ alkyl group, and R' is a substituted or unsubstituted $C_1$-$C_{10}$ alkyl group;

(6)

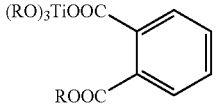

where R is a substituted or unsubstituted $C_1$-$C_{10}$ alkyl group; and (7)

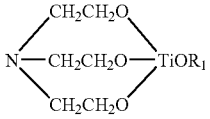

where $R_1$ is a substituted or unsubstituted $C_1$-$C_{10}$ alkyl group.

12. The conductive wet coating composition of claim 9, wherein the soluble titanium precursor is selected from the groups represented by the following formulas:

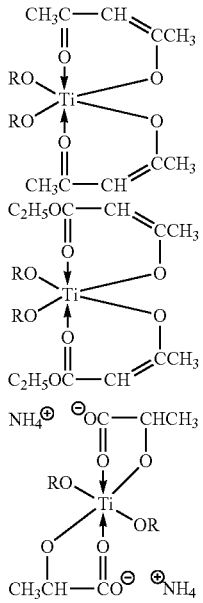

wherein R is a $C_1$-$C_{10}$ alkyl group.

13. The conductive wet coating composition of claim 1, wherein the conductive nanoparticle selected from the group consisting of CdS, CdSe, CdTe, ZnS, ZnSe, ZnTe, HgS, HgSe, HgTe, GaN, GaP, GaAs, InP and InAs.

14. The conductive wet coating composition of claim 1, wherein the polymer binder comprising conductive resin and nonconductive resin.

15. A conductive thin film prepared by coating and drying the conductive wet coating composition according to claim 1.

16. An electrode comprising the conductive thin film according to claim 15.

17. A switching contact device comprising the conductive thin film according to claim 15.

18. An organic electroluminescent device including the conductive thin film according to claim 15.

19. A method of preparing a conductive thin film, comprising coating the composition of claim 1 and drying the coated composition.

20. A method of preparing a conductive thin film, comprising coating the composition of claim 1 at room temperature and drying the coated composition.

* * * * *